US010815764B1

(12) United States Patent
Yeung et al.

(10) Patent No.: US 10,815,764 B1
(45) Date of Patent: Oct. 27, 2020

(54) METHODS AND SYSTEMS FOR OPERATING A FLEET OF PUMPS

(71) Applicant: BJ Services, LLC, Tomball, TX (US)

(72) Inventors: Tony Yeung, Tomball, TX (US); Ricardo Rodriguez-Ramon, Tomball, TX (US); Diankui Fu, Tomball, TX (US); Warren Zemlak, Tomball, TX (US); Samir Nath Seth, Tomball, TX (US); Joseph Foster, Tomball, TX (US)

(73) Assignee: BJ Energy Solutions, LLC, Houston, TX (US)

( * ) Notice: Subject to any disclaimer, the term of this patent is extended or adjusted under 35 U.S.C. 154(b) by 0 days.

(21) Appl. No.: 16/946,082

(22) Filed: Jun. 5, 2020

Related U.S. Application Data

(60) Provisional application No. 62/899,951, filed on Sep. 13, 2019.

(51) Int. Cl.
*E21B 43/26* (2006.01)
*F04B 49/20* (2006.01)
*F04B 23/04* (2006.01)

(52) U.S. Cl.
CPC ..... *E21B 43/2607* (2020.05); *F04B 23/04* (2013.01); *F04B 49/20* (2013.01); *F04B 2201/1203* (2013.01)

(58) Field of Classification Search
CPC ..... E21B 43/2607; F04B 49/20; F04B 23/04; F04B 2201/1203
See application file for complete search history.

(56) References Cited

U.S. PATENT DOCUMENTS 2,498,229 A 2/1950 Adler
3,191,517 A 6/1965 Solzman
(Continued)

FOREIGN PATENT DOCUMENTS

CA 2693567 9/2014
CN 101949382 1/2011
(Continued)

OTHER PUBLICATIONS

ResearchGate, Answer by Byron Woolridge, found at https://www.researchgate.net/post/How_can_we_improve_the_efficiency_of_the_gas_turbine_cycles, Jan. 1, 2013.
(Continued)

*Primary Examiner* — James G Sayre
(74) *Attorney, Agent, or Firm* — Womble Bond Dickinson (US) LLP

(57) ABSTRACT

A system and method for operating a fleet of pumps for a turbine driven fracturing pump system used in hydraulic fracturing is disclosed. In an embodiment, a method of operating a fleet of pumps associated with a hydraulic fracturing system includes receiving a demand Hydraulic Horse Power (HHP) signal. The demand HHP signal may include the Horse Power (HP) required for the hydraulic fracturing system to operate and may include consideration for frictional and other losses. The method further includes operating all available pump units at a percentage of rating below Maximum Continuous Power (MCP) level, based at least in part on the demand HHP signal. Furthermore, the method may include receiving a signal for loss of power from one or more pump units. The method further includes operating one or more units at MCP level and operating one or more units at Maximum Intermittent Power (MIP) level to meet the demand HHP signal.

28 Claims, 7 Drawing Sheets

(56) References Cited

U.S. PATENT DOCUMENTS 3,257,031 A 6/1966 Dietz
3,378,074 A 4/1968 Kiel
3,773,438 A 11/1973 Hall et al.
3,791,682 A 2/1974 Mitchell
3,796,045 A 3/1974 Foster
3,820,922 A 6/1974 Buse et al.
4,010,613 A 3/1977 McInerney
4,031,407 A 6/1977 Reed
4,086,976 A 5/1978 Holm et al.
4,222,229 A 9/1980 Uram
4,269,569 A 5/1981 Hoover
4,311,395 A 1/1982 Douthitt et al.
4,357,027 A 11/1982 Zeitlow
4,457,325 A 7/1984 Green
4,470,771 A 9/1984 Hall et al.
4,754,607 A 7/1988 Mackay
4,782,244 A 11/1988 Wakimoto
4,796,777 A 1/1989 Keller
4,913,625 A 4/1990 Gerlowski
4,983,259 A 1/1991 Duncan
4,990,058 A 2/1991 Eslinger
5,537,813 A 7/1996 Davis et al.
5,560,195 A 10/1996 Anderson et al.
5,622,245 A 4/1997 Reik
5,651,400 A 7/1997 Corts et al.
5,678,460 A 10/1997 Walkowc
5,717,172 A 2/1998 Griffin, Jr. et al.
5,983,962 A 11/1999 Gerardot
6,041,856 A 3/2000 Thrasher et al.
6,050,080 A 4/2000 Horner
6,071,188 A 6/2000 O'Neill et al.
6,129,335 A 10/2000 Yokogi
6,145,318 A 11/2000 Kaplan et al.
6,279,309 B1 8/2001 Lawlor, II et al.
6,321,860 B1 11/2001 Reddoch
6,334,746 B1 1/2002 Nguyen et al.
6,530,224 B1 3/2003 Conchieri
6,543,395 B2 4/2003 Green
6,655,922 B1 12/2003 Flek
6,765,304 B2 7/2004 Baten et al.
6,786,051 B2 9/2004 Kristich et al.
6,851,514 B2 2/2005 Han et al.
6,859,740 B2 2/2005 Stephenson et al.
6,901,735 B2 6/2005 Lohn
7,065,953 B1 6/2006 Kopko
7,222,015 B2 5/2007 Davis et al.
7,388,303 B2 6/2008 Seiver
7,545,130 B2 6/2009 Latham
7,552,903 B2 6/2009 Dunn et al.
7,563,076 B2 7/2009 Brunet et al.
7,627,416 B2 12/2009 Batenburg et al.
7,677,316 B2 3/2010 Butler et al.
7,721,521 B2 5/2010 Kunkle et al.
7,730,711 B2 6/2010 Kunkle et al.
7,845,413 B2 12/2010 Shampine et al.
7,900,724 B2 3/2011 Promersberger et al.
7,921,914 B2 4/2011 Bruins et al.
7,938,151 B2 5/2011 Höckner
7,980,357 B2 7/2011 Edwards
8,083,504 B2 12/2011 Williams et al.
8,186,334 B2 5/2012 Ooyama
8,196,555 B2 6/2012 Ikeda et al.
8,316,936 B2 11/2012 Roddy et al.
8,506,267 B2 8/2013 Gambier et al.
8,575,873 B2 11/2013 Peterson et al.
8,616,005 B1 12/2013 Cousino, Sr. et al.
8,621,873 B2 1/2014 Robertson et al.
8,672,606 B2 3/2014 Glynn et al.
8,714,253 B2 5/2014 Sherwood et al.
8,770,329 B2 7/2014 Spitler
8,789,601 B2 7/2014 Broussard et al.
8,794,307 B2 8/2014 Coquilleau et al.
8,851,441 B2 10/2014 Acuna et al.
8,905,056 B2 12/2014 Kendrick
8,973,560 B2 3/2015 Krug
8,997,904 B2 4/2015 Cryer et al.
9,032,620 B2 5/2015 Frassinelli et al.
9,057,247 B2 6/2015 Kumar et al.
9,103,193 B2 8/2015 Coli et al.
9,121,257 B2 9/2015 Coli et al.
9,140,110 B2 9/2015 Coli et al.
9,187,982 B2 11/2015 Dehring et al.
9,212,643 B2 12/2015 Deliyski
9,341,055 B2 5/2016 Weightman et al.
9,346,662 B2 5/2016 Van Vliet et al.
9,366,114 B2 6/2016 Coli et al.
9,376,786 B2 6/2016 Numasawa
9,394,829 B2 7/2016 Cabeen et al.
9,395,049 B2 7/2016 Vicknair et al.
9,401,670 B2 7/2016 Minato et al.
9,410,410 B2 8/2016 Broussard et al.
9,410,546 B2 8/2016 Jaeger et al.
9,429,078 B1 8/2016 Crowe et al.
9,512,783 B2 12/2016 Veilleux et al.
9,534,473 B2 1/2017 Morris et al.
9,546,652 B2 1/2017 Yin
9,550,501 B2 1/2017 Ledbetter
9,556,721 B2 1/2017 Jang et al.
9,562,420 B2 2/2017 Morris et al.
9,570,945 B2 2/2017 Fischer
9,579,980 B2 2/2017 Cryer et al.
9,587,649 B2 3/2017 Oehring
9,611,728 B2 4/2017 Dehring
9,638,101 B1 5/2017 Crowe et al.
9,638,194 B2 5/2017 Wiegman et al.
9,650,871 B2 5/2017 Oehring et al.
9,656,762 B2 5/2017 Kamath et al.
9,689,316 B1 6/2017 Crom
9,739,130 B2 8/2017 Young
9,777,748 B2 10/2017 Lu et al.
9,803,467 B2 10/2017 Tang et al.
9,803,793 B2 10/2017 Davi et al.
9,809,308 B2 11/2017 Aguilar et al.
9,829,002 B2 11/2017 Crom
9,840,897 B2 12/2017 Larson
9,840,901 B2 * 12/2017 Oehring ..... H02P 23/00
9,850,422 B2 12/2017 Lestz et al.
9,856,131 B1 1/2018 Moffitt
9,863,279 B2 1/2018 Laing et al.
9,869,305 B1 1/2018 Crowe et al.
9,879,609 B1 1/2018 Crowe et al.
9,893,500 B2 2/2018 Oehring et al.
9,893,660 B2 2/2018 Peterson et al.
9,920,615 B2 3/2018 Zhang et al.
9,945,365 B2 4/2018 Hernandez et al.
9,964,052 B2 5/2018 Millican et al.
9,970,278 B2 5/2018 Broussard et al.
9,981,840 B2 5/2018 Shock
9,995,102 B2 6/2018 Dillie et al.
9,995,218 B2 6/2018 Oehring et al.
10,008,880 B2 6/2018 Vicknair et al.
10,018,096 B2 7/2018 Wallimann et al.
10,020,711 B2 7/2018 Oehring et al.
10,029,289 B2 7/2018 Wendorski et al.
10,030,579 B2 7/2018 Austin et al.
10,036,238 B2 7/2018 Oehring
10,040,541 B2 8/2018 Wilson et al.
10,060,349 B2 8/2018 Álvarez et al.
10,082,137 B2 9/2018 Graham et al.
10,100,827 B2 10/2018 Devan et al.
10,107,084 B2 10/2018 Coli et al.
10,107,085 B2 10/2018 Coli et al.
10,114,061 B2 10/2018 Frampton et al.
10,119,381 B2 11/2018 Oehring et al.
10,134,257 B2 11/2018 Zhang et al.
10,151,244 B2 12/2018 Giancotti et al.
10,174,599 B2 1/2019 Shampine et al.
10,184,397 B2 1/2019 Austin et al.
10,196,258 B2 2/2019 Kalala et al.
10,221,856 B2 3/2019 Hernandez et al.
10,227,854 B2 3/2019 Glass
10,227,855 B2 3/2019 Coli et al.
10,246,984 B2 4/2019 Payne et al.
10,247,182 B2 4/2019 Zhang et al.

(56) References Cited

U.S. PATENT DOCUMENTS 10,254,732 B2 4/2019 Oehring et al.
10,267,439 B2 4/2019 Pryce et al.
10,280,724 B2 5/2019 Hinderliter
10,287,943 B1 5/2019 Schiltz
10,303,190 B2 5/2019 Shock
10,316,832 B2 6/2019 Byrne
10,317,875 B2 6/2019 Pandurangan
10,337,402 B2 7/2019 Austin et al.
10,371,012 B2 8/2019 Davis et al.
10,374,485 B2 8/2019 Morris et al.
10,378,326 B2 8/2019 Morris et al.
10,393,108 B2 8/2019 Chong et al.
10,407,990 B2 9/2019 Oehring et al.
10,408,031 B2 9/2019 Oehring et al.
10,415,348 B2 9/2019 Zhang et al.
10,415,557 B1 9/2019 Crowe et al.
10,415,562 B2 9/2019 Kajita et al.
2004/0016245 A1 1/2004 Pierson
2004/0187950 A1 9/2004 Cohen et al.
2005/0139286 A1 6/2005 Poulter
2005/0226754 A1 10/2005 Off et al.
2006/0260331 A1 11/2006 Andreychuk
2007/0029090 A1 2/2007 Andreychuk et al.
2007/0107981 A1 5/2007 Sicotte
2007/0181212 A1 8/2007 Fell
2007/0277982 A1* 12/2007 Shampine ..... E21B 43/16 166/308.1
2007/0295569 A1 12/2007 Manzoor et al.
2008/0098891 A1 5/2008 Feher
2008/0161974 A1 7/2008 Alston
2008/0264625 A1 10/2008 Ochoa
2008/0264649 A1 10/2008 Crawford
2009/0064685 A1 3/2009 Busekros et al.
2009/0124191 A1 5/2009 Van Becelaere et al.
2010/0071899 A1 3/2010 Coquilleau et al.
2010/0300683 A1 12/2010 Looper et al.
2010/0310384 A1 12/2010 Stephenson et al.
2011/0054704 A1 3/2011 Karpman et al.
2011/0085924 A1 4/2011 Shampine et al.
2011/0197988 A1 8/2011 Van Vliet et al.
2011/0241888 A1* 10/2011 Lu ..... F04D 15/0077 340/626
2011/0265443 A1 11/2011 Ansari
2011/0272158 A1 11/2011 Neal
2012/0048242 A1 3/2012 Sumilla et al.
2012/0310509 A1 12/2012 Pardo et al.
2013/0068307 A1 3/2013 Hains et al.
2013/0284455 A1 10/2013 Kajaria et al.
2013/0300341 A1 11/2013 Gillette
2013/0306322 A1 11/2013 Sanborn
2014/0048253 A1 2/2014 Andreychuk
2014/0090742 A1 4/2014 Coskrey et al.
2014/0130422 A1 5/2014 Laing et al.
2014/0147291 A1 5/2014 Burnette
2014/0277772 A1* 9/2014 Lopez ..... E21B 43/26 700/282
2014/0290266 A1 10/2014 Veilleux, Jr. et al.
2014/0318638 A1 10/2014 Harwood et al.
2015/0078924 A1 3/2015 Zhang et al.
2015/0114652 A1 4/2015 Lestz et al.
2015/0192117 A1 7/2015 Bridges
2015/0204322 A1 7/2015 Iund et al.
2015/0211512 A1 7/2015 Wiegman et al.
2015/0217672 A1 8/2015 Shampine et al.
2015/0275891 A1 10/2015 Chong et al.
2015/0369351 A1 12/2015 Hermann et al.
2016/0032703 A1* 2/2016 Broussard ..... E21B 43/26 166/250.01
2016/0102581 A1 4/2016 Del Bono
2016/0105022 A1* 4/2016 Oehring ..... E21B 43/26 700/293
2016/0108713 A1* 4/2016 Dunaeva ..... C09K 8/68 166/280.2
2016/0177675 A1* 6/2016 Morris ..... F01D 25/28 166/308.1
2016/0186671 A1 6/2016 Austin et al.
2016/0215774 A1 7/2016 Oklejas et al.
2016/0230525 A1 8/2016 Lestz et al.
2016/0244314 A1 8/2016 Van Vliet et al.
2016/0248230 A1 8/2016 Tawy et al.
2016/0253634 A1 9/2016 Thomeer et al.
2016/0273346 A1 9/2016 Tang et al.
2016/0290114 A1 10/2016 Oehring et al.
2016/0319650 A1 11/2016 Oehring et al.
2016/0348479 A1 12/2016 Oehring et al.
2016/0369609 A1 12/2016 Morris et al.
2017/0009905 A1 1/2017 Arnold
2017/0016433 A1 1/2017 Chong et al.
2017/0030177 A1 2/2017 Oehring et al.
2017/0038137 A1 2/2017 Turney
2017/0074076 A1 3/2017 Joseph et al.
2017/0082110 A1 3/2017 Lammers
2017/0089189 A1 3/2017 Norris et al.
2017/0145918 A1 5/2017 Oehring et al.
2017/0218727 A1 8/2017 Oehring et al.
2017/0226839 A1 8/2017 Broussard et al.
2017/0227002 A1 8/2017 Mikulski et al.
2017/0234165 A1 8/2017 Kersey et al.
2017/0234308 A1 8/2017 Buckley
2017/0248034 A1 8/2017 Dzieciol et al.
2017/0275149 A1 9/2017 Schmidt
2017/0292409 A1 10/2017 Aguilar et al.
2017/0302135 A1 10/2017 Cory
2017/0305736 A1 10/2017 Haile et al.
2017/0334448 A1 11/2017 Schwunk
2017/0350471 A1 12/2017 Steidl et al.
2017/0370199 A1 12/2017 Witkowski et al.
2018/0034280 A1 2/2018 Pedersen
2018/0038216 A1* 2/2018 Zhang ..... E21B 43/26
2018/0038328 A1 2/2018 Louven et al.
2018/0041093 A1 2/2018 Miranda
2018/0045202 A1 2/2018 Crom
2018/0058171 A1 3/2018 Roesner et al.
2018/0156210 A1 6/2018 Oehring et al.
2018/0172294 A1 6/2018 Owen
2018/0183219 A1 6/2018 Oehring et al.
2018/0186442 A1 7/2018 Maier
2018/0187662 A1* 7/2018 Hill ..... F04B 15/02
2018/0223640 A1 8/2018 Keihany et al.
2018/0224044 A1 8/2018 Penney
2018/0229998 A1 8/2018 Shock
2018/0258746 A1 9/2018 Broussard et al.
2018/0266412 A1 9/2018 Stokkevag et al.
2018/0278124 A1 9/2018 Oehring et al.
2018/0283102 A1 10/2018 Cook
2018/0283618 A1 10/2018 Cook
2018/0284817 A1 10/2018 Cook et al.
2018/0291781 A1 10/2018 Pedrini
2018/0298731 A1 10/2018 Bishop
2018/0298735 A1 10/2018 Conrad
2018/0307255 A1 10/2018 Bishop
2018/0328157 A1 11/2018 Bishop
2018/0334893 A1 11/2018 Oehring
2018/0363435 A1 12/2018 Coli et al.
2018/0363436 A1 12/2018 Coli et al.
2018/0363437 A1 12/2018 Coli et al.
2018/0363438 A1 12/2018 Coli et al.
2019/0003272 A1 1/2019 Morris et al.
2019/0003329 A1 1/2019 Morris et al.
2019/0010793 A1 1/2019 Hinderliter
2019/0067991 A1 2/2019 Davis et al.
2019/0071992 A1 3/2019 Feng
2019/0072005 A1 3/2019 Fisher et al.
2019/0106316 A1 4/2019 Van Vliet et al.
2019/0106970 A1 4/2019 Oehring
2019/0112908 A1 4/2019 Coli et al.
2019/0112910 A1 4/2019 Oehring et al.
2019/0119096 A1 4/2019 Haile et al.
2019/0120024 A1 4/2019 Oehring et al.
2019/0120031 A1 4/2019 Gilje
2019/0120134 A1 4/2019 Goleczka et al.
2019/0131607 A1 5/2019 Gillette

(56) References Cited

U.S. PATENT DOCUMENTS

| | | | |
|---|---|---|---|
| 2019/0136677 | A1 | 5/2019 | Shampine et al. |
| 2019/0154020 | A1 | 5/2019 | Glass |
| 2019/0264667 | A1 | 5/2019 | Byrne |
| 2019/0178234 | A1 | 6/2019 | Beisel |
| 2019/0185312 | A1 | 6/2019 | Bush et al. |
| 2019/0204021 | A1 | 7/2019 | Morris et al. |
| 2019/0226317 | A1 | 7/2019 | Payne et al. |
| 2019/0245348 | A1 | 8/2019 | Hinderliter et al. |
| 2019/0249754 | A1 | 8/2019 | Oehring et al. |
| 2019/0316447 | A1 | 10/2019 | Oehring et al. |
| 2019/0323337 | A1 | 10/2019 | Glass et al. |
| 2020/0141907 | A1 | 5/2020 | Meck et al. |
| 2020/0166026 | A1 | 5/2020 | Marica |

FOREIGN PATENT DOCUMENTS

| | | |
|---|---|---|
| CN | 101885307 | 7/2012 |
| CN | 203412658 | 1/2014 |
| CN | 103790927 | 12/2015 |
| CN | 105207097 | 12/2015 |
| CN | 102602323 | 1/2016 |
| CN | 204944834 | 1/2016 |
| CN | 106715165 | 5/2017 |
| CN | 107120822 | 9/2017 |
| CN | 107956708 | 4/2018 |
| CN | 110159432 | 8/2019 |
| DE | 4241614 | 6/1994 |
| DE | 102012018825 | 3/2014 |
| EP | 0835983 | 4/1998 |
| EP | 1378683 | 1/2004 |
| EP | 2143916 | 1/2010 |
| EP | 2613023 | 7/2013 |
| EP | 3095989 | 11/2016 |
| EP | 3211766 | 8/2017 |
| EP | 3354866 | 8/2018 |
| GB | 1438172 | 6/1976 |
| JP | S57135212 | 2/1984 |
| KR | 20020026398 | 4/2002 |
| RU | 13562 | 4/2000 |
| WO | 1993020328 | 10/1993 |
| WO | 2006025886 | 3/2006 |
| WO | 2009023042 | 2/2009 |
| WO | 2017213848 | 12/2017 |
| WO | 2018031029 | 2/2018 |
| WO | 2018038710 | 3/2018 |
| WO | 2018044293 | 3/2018 |
| WO | 2018044307 | 3/2018 |
| WO | 2018071738 | 4/2018 |
| WO | 2018101909 | 6/2018 |
| WO | 2018101912 | 6/2018 |
| WO | 2018106210 | 6/2018 |
| WO | 2018106225 | 6/2018 |
| WO | 2018106252 | 6/2018 |
| WO | 2018156131 | 8/2018 |
| WO | 2018075034 | 10/2018 |
| WO | 2018187346 | 10/2018 |
| WO | 2018031031 | 2/2019 |
| WO | 2019045691 | 3/2019 |
| WO | 2019060922 | 3/2019 |
| WO | 2019126742 | 6/2019 |
| WO | 2019147601 | 8/2019 |
| WO | 2019169366 | 9/2019 |

OTHER PUBLICATIONS

Filipović, Ivan, Preliminary Selection of Basic Parameters of Different Torsional Vibration Dampers Intended for use in Medium-Speed Diesel Engines, Transactions of Farmena XXXVI-3 (2012).
Marine Turbine Technologies, 1 MW Power Generation Package, http://marineturbine.com/power-generation, 2017.
Business Week: Fiber-optic cables help fracking, cablinginstall.com. Jul. 12, 2013. https://www.cablinginstall.com/cable/article/16474208/businessweek-fiberoptic-cables-help-fracking.
Fracking companies switch to electric motors to power pumps, iadd-intl.org. Jun. 27, 2019. https://www.iadd-intl.org/articles/fracking-companies-switch-to-electric-motors-to-power-pumps/.
The Leader in Frac Fueling, suncoastresources.com. Jun. 29, 2015. https://web.archive.org/web/20150629220609/https://www.suncoastresources.com/oilfield/fueling-services/.
Mobile Fuel Delivery, atlasoil.com. Mar. 6, 2019. https://www.atlasoil.com/nationwide-fueling/onsite-and-mobile-fueling.
Frac Tank Hose (FRAC), 4starhose.com. Accessed: Nov. 10, 2019. http://www.4starhose.com/product/frac_tank_hose_frac_aspx.
PLOS ONE, Dynamic Behavior of Reciprocating Plunger Pump Discharge Valve Based on Fluid Structure Interaction and Experimental Analysis. Oct. 21, 2015.
FMC Technologies, Operation and Maintenance Manual, L06 Through L16 Triplex Pumps Doc No. OMM50000903 Rev: E p. 1 of 66. Aug. 27, 2009.
Gardner Denver Hydraulic Fracturing Pumps GD 3000 https://www.gardnerdenver.com/en-us/pumps/triplex-tracking-pump-gd-3000.
Lekontsev, Yu M., et al. "Two-side sealer operation." Journal of Mining Science 49.5 (2013): 757-762.
Tom Hausfeld, GE Power & Water, and Eldon Schelske, Evolution Well Services, TM2500+ Power for Hydraulic Fracturing.
FTS International's Dual Fuel Hydraulic Fracturing Equipment Increases Operational Efficiencies, Provides Cost Benefits, Jan. 3, 2018.
CNG Delivery, Fracturing with natural gas, dual-fuel drilling with CNG, Aug. 22, 2019.
PbNG, Natural Gas Fuel for Drilling and Hydraulic Fracturing, Diesel Displacement / Dual Fuel & Bi-Fuel, May 2014.
Integrated Flow, Skid-mounted Modular Process Systems, https://ifsolutions.com/.
Cameron, A Schlumberger Company, Frac Manifold Systems, 2016.
ZSi-Foster, Energy | Solar | Fracking | Oil and Gas, https://www.zsi-foster.com/energy-solar-fracking-oil-and-gas.html.
JBG Enterprises, Inc., WS-Series Blowout Prevention Safety Coupling—Quick Release Couplings, http://www.jgbhose.com/products/WS-Series-Blowout-Prevention-Safety-Coupling.asp.
Halliburton, Vessel-based Modular Solution (VMS), 2015.
Chun, M. K., H. K. Song, and R. Lallemand. "Heavy duty gas turbines in petrochemical plants: Samsung's Daesan plant (Korea) beats fuel flexibility records with over 95% hydrogen in process gas." Proceedings of PowerGen Asia Conference, Singapore. 1999.
Wolf, Jürgen J., and Marko A. Perkavec. "Safety Aspects and Environmental Considerations for a 10 MW Cogeneration Heavy Duty Gas Turbine Burning Coke Oven Gas with 60% Hydrogen Content." ASME 1992 International Gas Turbine and Aeroengine Congress and Exposition. American Society of Mechanical Engineers Digital Collection, 1992.
Ginter, Timothy, and Thomas Bouvay. "Uprate options for the MS7001 heavy duty gas turbine." GE paper GER-3808C, GE Energy 12 (2006).
Chaichan, Miqdam Tariq. "The impact of equivalence ratio on performance and emissions of a hydrogen-diesel dual fuel engine with cooled exhaust gas recirculation." International Journal of Scientific & Engineering Research 6.6 (2015): 938-941.
Ecob, David J., et al. "Design and Development of a Landfill Gas Combustion System for the Typhoon Gas Turbine." ASME 1996 International Gas Turbine and Aeroengine Congress and Exhibition. American Society of Mechanical Engineers Digital Collection, 1996.
II-VI Marlow Industries, Thermoelectric Technologies in Oil, Gas, and Mining Industries, blog.marlow.com (Jul. 24, 2019).
B.M. Mahlalela, et al., .Electric Power Generation Potential Based on Waste Heat and Geothermal Resources in South Africa, pangea.stanford.edu (Feb. 11, 2019).
Department of Energy, United States of America, The Water-Energy Nexus: Challenges and Opportunities purenergypolicy.org (Jun. 2014).
Ankit Tiwari, Design of a Cooling System for a Hydraulic Fracturing Equipment, The Pennsylvania State University, The Graduate School, College of Engineering, 2015.
Jp Yadav et al., Power Enhancement of Gas Turbine Plant by Intake Air Fog Cooling, Jun. 2015.

(56) References Cited

OTHER PUBLICATIONS

Mee Industries: Inlet Air Fogging Systems for Oil, Gas and Petrochemical Processing, Verdict Media Limited Copyright 2020.
M. Ahmadzadehtalatapeh et al.Performance enhancement of gas turbine units by retrofitting with inlet air cooling technologies (IACTs): an hour-by-hour simulation study, Journal of the Brazilian Society of Mechanical Sciences and Engineering, Mar. 2020.
Advances in Popular Torque-Link Solution Offer OEMs Greater Benefit, Jun. 21, 2018.
Emmanuel Akita et al., Mewbourne College of Earth & Energy, Society of Petroleum Engineers; Drilling Systems Automation Technical Section (DSATS); 2019.
PowerShelter Kit II, nooutage.com, Sep. 6, 2019.
EMPengineering.com, HEMP Resistant Electrical Generators / Hardened Structures HEMP/GMD Shielded Generators, Virginia.
Blago Minovski, Coupled Simulations of Cooling and Engine Systems for Unsteady Analysis of the Benefits of Thermal Engine Encapsulation, Department of Applied Mechanics, Chalmers University of Technology Goteborg, Sweden 2015.
J. Porteiro et al., Feasibility of a new domestic CHP trigeneration with heat pump: II. Availability analysis. Design and development, Applied Thermal Engineering 24 (2004) 1421-1429.
Europump and Hydrualic Institute, Variable Speed Pumping: A Guide to Successful Applications, Elsevier Ltd, 2004.
Capstone Turbine Corporation, Capstone Receives Three Megawatt Order from Large Independent Oil & Gas Company in Eagle Ford Shale Play, Dec. 7, 2010.
Wikipedia, Westinghouse Combustion Turbine Systems Division, https://en.wikipedia.org/wiki/Westinghouse_Combustion_Turbine_Systems_Division, circa 1960.
Wikipedia,Union Pacific GTELs, https://en.wikipedia.org/wiki/Union_Pacific_GTELs, circa 1950.
HCI JET Frac, Screenshots from YouTube, Dec. 11, 2010. https://www.youtube.com/watch?v=6HjXkdbFaFQ.
AFD Petroleum Ltd., Automated Hot Zone, Frac Refueling System, Dec. 2018.
Eygun, Christiane, et al., URTeC: 2687987, Mitigating Shale Gas Developments Carbon Footprint: Evaluating and Implementing Solutions in Argentina, Copyright 2017, Unconventional Resources Technology Conference.
Walzel, Brian, Hart Energy, Oil, Gas Industry Discovers Innovative Solutions to Environmental Concerns, Dec. 10, 2018.
FRAC SHACK, Bi-Fuel FracFueller brochure, 2011.
Pettigrew, Dana, et al., High Pressure Multi-Stage Centrifugal Pump for 10,000 psi Frac Pump—IPHPS FRAC Pump, Copyright 2013, Society of Petroleum Engineers, SPE 166191.
Elle Seybold, et al., Evolution of Dual Fuel Pressure Pumping for Fracturing: Methods, Economics, Field Trial Results and Improvements in Availability of Fuel, Copyright 2013, Society of Petroleum Engineers, SPE 166443.
Wallace, E.M., Associated Shale Gas: From Flares to Rig Power, Copyright 2015, Society of Petroleum Engineers, SPE-173491-MS.
Williams, C.W. (Gulf Oil Corp. Odessa Texas), The Use of Gas-turbine Engines in an Automated High-Pressure Water injection Stations; American Petroleum Institute; API-63-144 (Jan. 1, 1963).
Neal, J.C. (Gulf Oil Corp. Odessa Texas), Gas Turbine Driven Centrifugal Pumps for High Pressure Water Injection; American Institute of Mining, Metallurgical and Petroleum Engineers, Inc.; SPE-1888 (1967).
Porter, John A. (Solar Division International Harvester Co.), Modern Industrial Gas Turbines for the Oil Field; American Petroleum Institute; Drilling and Production Practice; API-67-243 (Jan. 1, 1967).
Cooper et al., Jet Frac Porta-Skid—A New Concept in Oil Field Service Pump Equipments[sic]; Halliburton Services; SPE-2706 (1969).
Ibragimov, É.S., Use of gas-turbine engines in oil field pumping units; Chem Petrol Eng; (1994) 30: 530. https://doi.org/10.1007/BF01154919. (Translated from Khimicheskaya i Neftyanoe Mashinostroenie, No. 11, pp. 24-26, Nov. 1994.).
Kas'yanov et al., Application of gas-turbine engines in pumping units complexes of hydraulic fracturing of oil and gas reservoirs; Exposition Oil & Gas; (Oct. 2012) (published in Russian).

* cited by examiner

METHODS AND SYSTEMS FOR OPERATING A FLEET OF PUMPS

CROSS REFERENCE TO RELATED APPLICATIONS

This application claims the benefit of and priority to U.S. Provisional Patent Application No. 62/899,951, which was filed on Sep. 13, 2019, and hereby is incorporated by reference for all purposes as if presented herein in its entirety.

BACKGROUND OF THE DISCLOSURE

This disclosure relates to operating a fleet of pumps for hydraulic fracturing and, in particular, to systems and methods for operating a directly driven turbine fracturing pump system for hydraulic fracturing application.

Traditional Diesel fracturing pumping fleets have a large footprint and often need additional auxiliary equipment to achieve the horsepower required for hydraulic fracturing. FIG. 1 shows a typical pad layout for a fracturing pump system 100 including fracturing or frac pumps 101*a* through 101*i*, with the pumps all being driven by a diesel powered engine and operatively connected to a manifold 105 that is operatively connected to a wellhead 110. By way of an example, in order to achieve a maximum rated horsepower of 24,000 HP, a quantity of eight (8) 3000 HP pumping units (101*a*-101*h* or frac pump 1 to frac pump 8) may be required as well as an additional one (1) spare unit (101*i* or frac pump 9) that may be readily brought online if one of the operating units is brought off line for either maintenance purposes or for immediate repairs. The numbers above are provided by way of an example and do not include frictional and other losses from prime mover to the pumps.

The layout as indicated in FIG. 1 requires a large footprint of service equipment, including hoses, connections, assemblies and other related equipment that may be potential employee hazards. Additionally, the spare unit, such as the one indicated by 101*i* in FIG. 1, may need to be kept on standby so that additional fuel may be utilized, thereby adding further equipment requirements to the footprint that may be yet further potential employee hazards.

Accordingly, Applicant has recognized that a need exists for more efficient ways of managing power requirement for a hydraulic fracturing fleet while minimizing equipment layout foot print. The present disclosure addresses these and other related and unrelated problems in the art.

SUMMARY OF THE DISCLOSURE

According to one embodiment of the disclosure, a method of operating a plurality of pump units associated with a high-pressure, high-power hydraulic fracturing assembly is provided. Each of the pump units may include a turbine engine, a driveshaft, a gearbox connected to the turbine engine and driveshaft for driving the driveshaft, and a pump connected to the driveshaft. The method may include receiving a demand hydraulic horse power (HHP) signal for operation of the hydraulic fracturing assembly. Based at least in part on the demand HHP signal, the method may include operating all available pump units of the plurality of pump units at a first output power to achieve the demand HHP. The method may include receiving a loss of power signal for at least one pump unit of the plurality of pump units during operation of the plurality of pump units, and after receiving the loss of power signal, designating the at least one pump unit as a reduced power pump unit (RPPU) and the remaining pump units as operating pump units (OPU). The method may further include operating at least one of the OPUs at a second output power to meet the demand HHP signal for operation of the hydraulic fracturing assembly. The first output power may be in the range of approximately 70% to 100% of a maximum continuous power (MCP) level of the plurality of pump units, the second output power may be greater than the first output power and may be in the range of approximately 70% of the MCP level to approximately a maximum intermittent power (MIP) level of the plurality of pump units.

According to another embodiment of the disclosure, a system is disclosed to control operation of a plurality of pump units associated with a hydraulic fracturing assembly. Each of the pump units may include a turbine engine connected to a gearbox for driving a driveshaft, and a pump connected to the drive shaft. The system includes a controller in communication with the plurality of pump units. The controller may include one or more processors and memory having computer-readable instructions stored therein and may be operable by the processor to receive a demand hydraulic horse power (HHP) signal for the hydraulic fracturing assembly. Based at least in part on the demand HHP signal, the controller may operate all available pump units of the plurality of pump units at a first output power to achieve the demand HHP, and may receive a loss of power signal from at least one pump unit of the plurality of pump units. After receiving the loss of power signal, the controller may designate the at least one pump unit as a reduced power pump unit (RPPU), and designate the remaining pump units as operating pump units (OPU). The controller may further operate one or more of the OPUs at a second output power to meet the demand HHP signal of the hydraulic fracturing system. The first output power may be in the range of approximately 70% to 100% of a maximum continuous power (MCP) level of the plurality of pump units. The second output power may be greater than the first output power and may be in the range of approximately 70% of MCP level to approximately a maximum intermittent power (MIP) level of the plurality of pump units.

Those skilled in the art will appreciate the benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE FIGURES

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

Generally, this disclosure is directed to methods and systems for controlling a fleet of DDT pumping units 11 (FIG. 3) as part of a high-pressure, high-power, fluid pumping system 400 (FIG. 2) for use in hydraulic fracturing operations. The systems and method of the present disclosure, for example, help reduce or eliminate the need for a spare pumping unit to be associated with the fluid pumping system 400, among other features.

Figure 1:
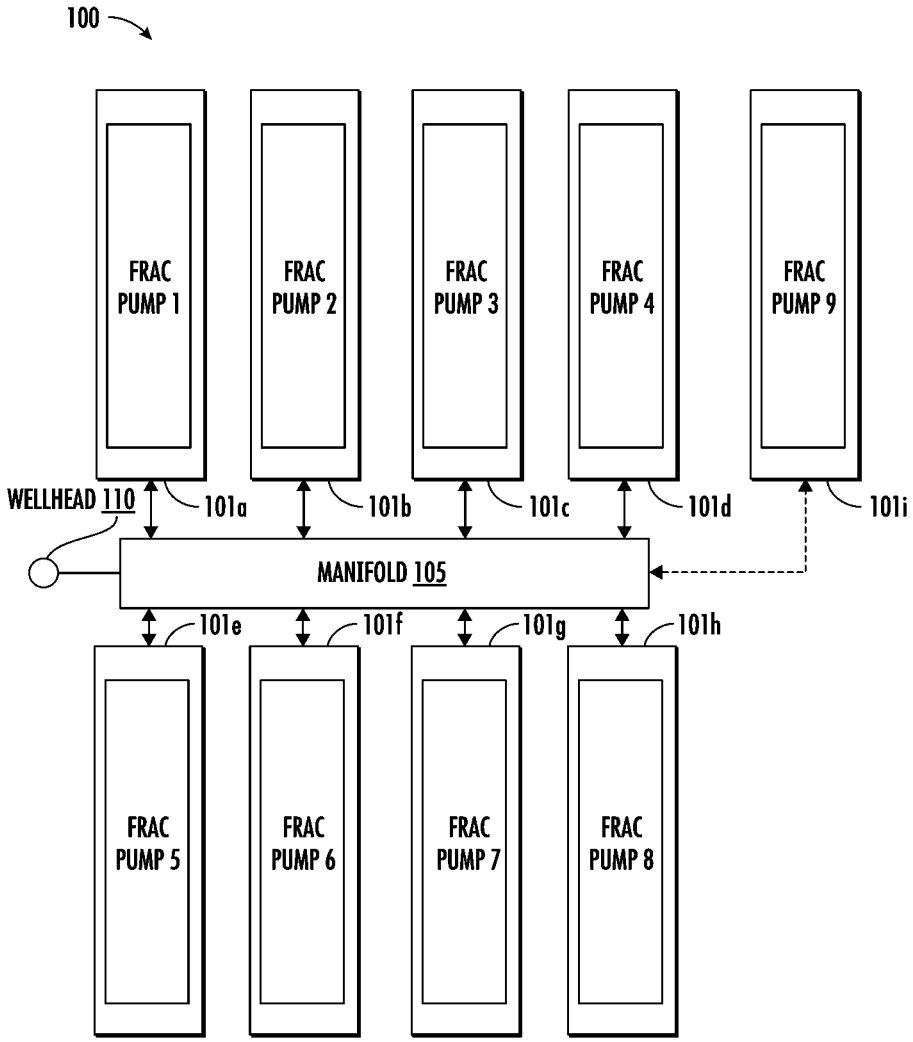
FIG. 1 PRIOR ART
FIG. 1 is a schematic diagram of a typical prior art fracturing pad layout for a hydraulic fracturing application according to the prior art.
Figure 2:
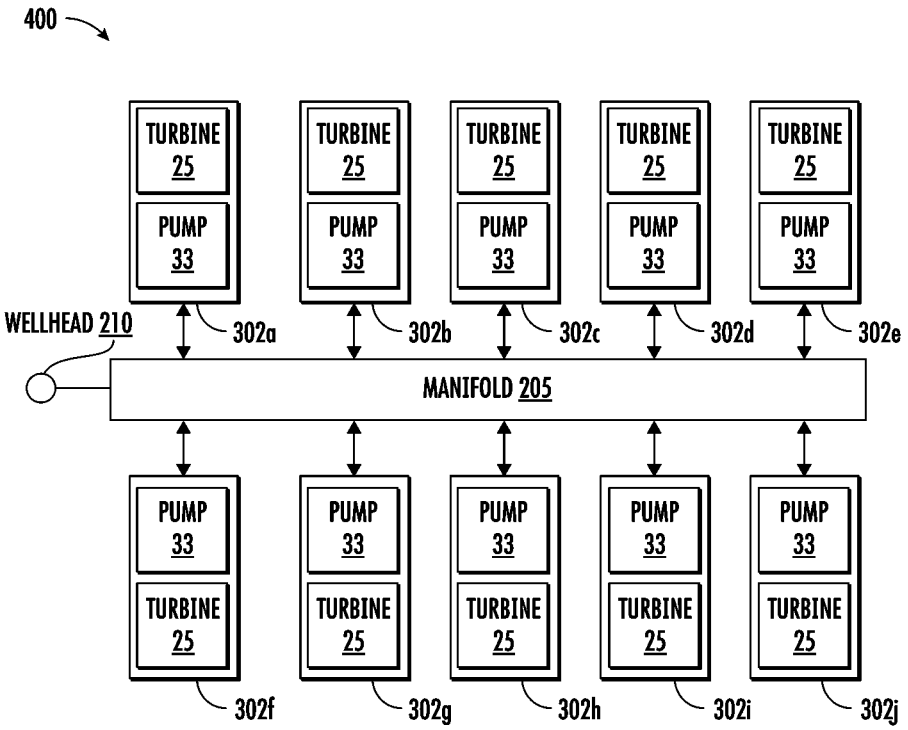
FIG. 2 is a schematic diagram of a layout of a fluid pumping system according to an embodiment of the disclosure.
Figure 3:
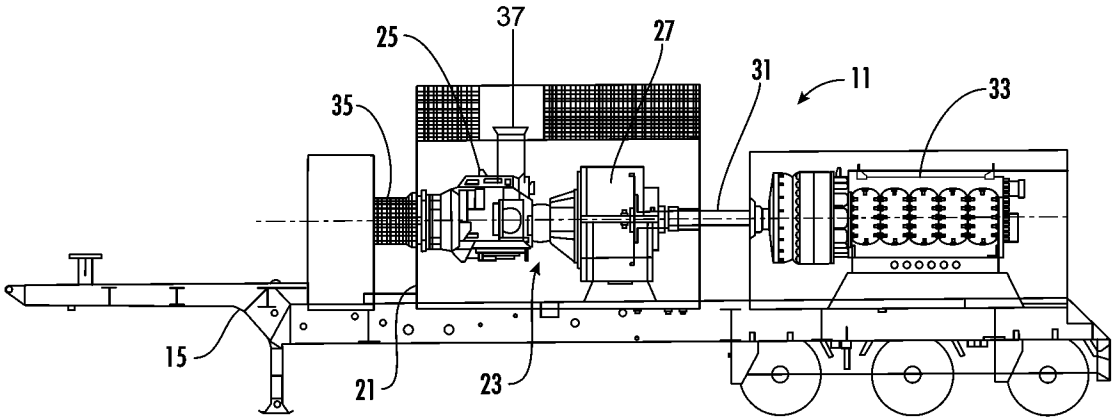
FIG. 3 is a schematic diagram of a directly driven turbine (DDT) pumping unit used in the fluid pumping system of FIG. 2 according an embodiment of the disclosure.

FIG. 3 illustrates a schematic view of a pumping unit 11 for use in a high-pressure, high power, fluid pumping system 400 (FIG. 2) for use in hydraulic fracturing operations according to one embodiment of the disclosure. FIG. 2 shows a pad layout of the pumping units 11 (indicated as 302*a* thru 302*j*) with the pumping units all operatively connected to a manifold 205 that is operatively connected to a wellhead 210. By way of an example, the system 400 is a hydraulic fracturing application that may be sized to deliver a total Hydraulic Horse Power (HHP) of 41,000 to the wellhead 210 as will be understood by those skilled in the art. In the illustrated embodiment, a quantity of ten pumping units 11 are used, but the system 400 may be otherwise configured to use more or less than then pumping units without departing from the disclosure. As shown in FIG. 3, each of the pumping units 11 are mounted on a trailer 15 for transport and positioning at the jobsite. Each pumping unit 11 includes an enclosure 21 that houses a direct drive unit (DDU) 23 including a gas turbine engine (GTE) 25 operatively connected to a gearbox 27. The pumping unit 11 has a driveshaft 31 operatively connected to the gearbox 27. The pumping unit 11, for example, may include a high-pressure, high-power, reciprocating positive displacement pump 33 that is operatively connected to the DDU 23 via the driveshaft 31. In one embodiment, the pumping unit 11 is mounted on the trailer 15 adjacent the DDU 23. The trailer 15 includes other associated components such as a turbine exhaust duct 35 operatively connected to the gas turbine engine 25, air intake duct 37 operatively connected to the gas turbine, and other associated equipment hoses, connections, etc. to facilitate operation of the fluid pumping unit 11. In one embodiment, the gas turbine engine 25 may operate on primary fuel, which may include gas fuels, such as, for example, compressed natural gas (CNG), natural gas, field gas or pipeline gas, and on secondary fuel, which may include liquid fuels, such as, for example, #2 Diesel or Bio-fuels.

In an embodiment, the gas turbine engine 25 may be a dual shaft, dual fuel turbine with a rated shaft horsepower (SHP) of 5100 at standard conditions, or other suitable gas turbine. The gearbox 27 may be a reduction helical gearbox that has a constant running power rating of 5500 SHP and intermittent power output of 5850 SHP, or other suitable gearbox. The driveshaft 31 may be a 390 Series, GWB Model 390.80 driveshaft available from Dana Corporation, or other suitable driveshaft. In one example, the pump 33 may be a high-pressure, high-power, reciprocating positive displacement pump rated at 5000 HP, but the pump may be rated to an elevated horsepower above the gas turbine engine 25, e.g., 7000 HP, or may be otherwise sized without departing from the disclosure.

In one embodiment, for example, the desired HHP of the fluid pumping system 400 may be 41,000 HHP and the fluid pumping system 400 having ten pump units 302*a* thru 302*j* that deliver the 41,000 HHP by each operating at an operating power below a Maximum Continuous Power (MCP) rating of each the pump unit. The Maximum Continuous Power (MCP) level of the pump corresponds to the maximum power at which the individual pump units 302*a* thru 302*j* may sustain continuous operation without any performance or reliability penalties. In one example, the ten pump units 302*a* thru 302*j* may operate at approximately 80% MCP to deliver the 41,000 HHP required for the fluid pumping system 400. The Maximum Intermittent Power (MIP) level of a pump unit 302*a* thru 302*j* is an elevated operating output level that the pump unit may operate intermittently throughout its operating life without excessive damage to the pump unit. The operation of a pump unit 302*a* thru 302*j* at or above the MIP power level may incur penalties associated with pump unit life cycle estimates and other warranties. The MIP power level for a DDT pump unit 302*a* thru 302*j* may be attained by over-firing the turbine engine 25 associated with the pump unit 302*a* thru 302*j* or by other means of operation. The MIP power level of the pump units 302*a* thru 302*j* is typically an amount above the MCP level and may typically range from 101% of rated MCP to 110% of rated MCP. In an embodiment of the disclosure, the MIP level may be set at 107% of rated power. In other embodiments, the MIP level may be greater than 110% of rated MCP without departing from the disclosure.

Figure 4:
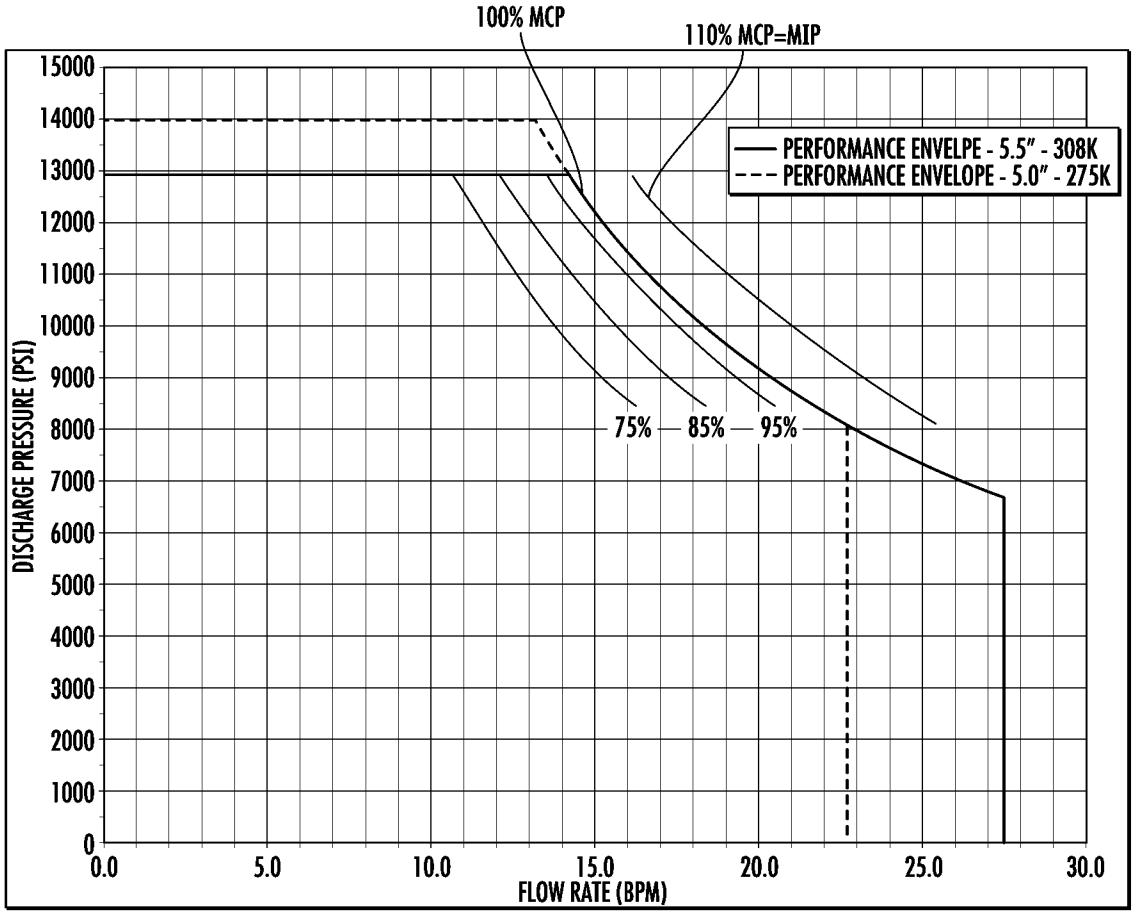
FIG. 4 is a pump operating curve for a DDT pumping unit of FIG. 3.

FIG. 4 illustrates a graph of a discharge pressure vs. flow rate curve for exemplary pump units 302*a* thru 302*j* of the present disclosure. As indicated in FIG. 4, the pump units 302*a*-302*j* (as an example, 5000 HP pump units are shown) may operate in typical operating range of approximately 75% to 95% of MCP to deliver the required HHP of the fluid pumping system 400 for a particular well site. The corresponding percentage of MCP of the pump units 302*a*-302*j* is indicated by the 75%, 85%, and 95% lines that are parallel to the 100% MCP line. Any operation of the pump unit 302*a* thru 302*j* beyond the 100% MCP curve should be an intermittent occurrence to avoid damage to the pump unit. In one example, the MIP is indicated at 110% MCP, but the MIP may be other percentages to the right of the 100% MCP line without departing from the disclosure. One or more of these parallel curves below the 100% MCP line may demonstrate the percentage of the maximum pump power output that may be required to maintain the HHP of the fluid pumping system 400. The two lines, i.e., solid line (5.5") and dashed line (5.0") respectively correspond to the diameter of a plunger being used in a reciprocating pump. As will be understood by those skilled in the art, some pump manufacturer may make pumps with plunger/packing assemblies that vary from 4.5" to 5.5", for example. When the pumps run at equal power outputs, there is a change or difference in a rod load (force) on the plunger due to differences in an elevated surface area, e.g., which is why one may have 308,000 lbs/f for a 5.5" plunger as compared to 275,000 lbs for a 5" plunger. A pump, in these situations for example, only may handle a certain amount of total HHP with either an elevated pressure (which is achieved with a larger plunger) and a compromised rate, or vice versa, as will be understood by those skilled in the art. In some embodiments, the 5" plunger may be desirable, and the different solid black lines are indicating performance at certain HHP outputs. As discussed below, upon a loss of power situation of one of the pumps units 302*a* thru 302*j*, the other pump units may operate above the desired/normal pump power output to maintain the needed HHP of the fluid pumping system 400.

Figure 5:
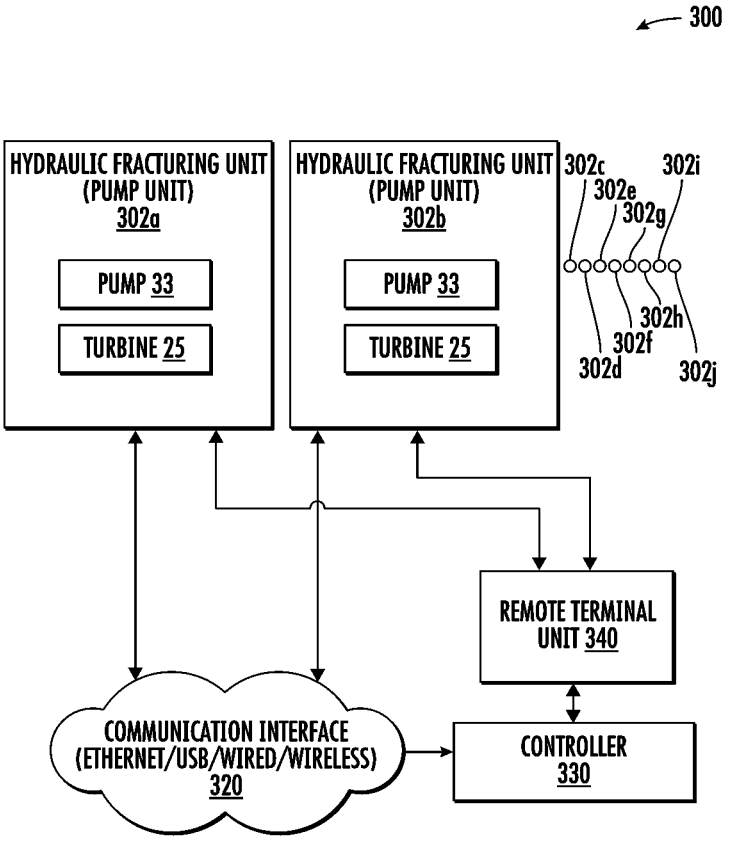
FIG. 5 is a schematic diagram of a system for controlling the fluid pumping system of FIG. 2.

FIG. 5 illustrates a schematic diagram of a system 300 for controlling operation of the fleet of pumps 302*a* thru 302*j* forming the directly Driven Turbine (DDT) pumping system 400 of the present disclosure. The system 300 controls the one or more hydraulic fracturing pump units 302*a* thru 302*j* that operate to provide the required HHP of the fluid pumping system 400. Only two pump units 302*a*, 302*b* are illustrated in detail in FIG. 3, but it is understood that all of the pump units will be controlled by the control system 300 to operate in a similar manner.

As shown in FIG. 5, the system 300 may also include one or more controllers, such as the controller or control system 330, which may control operations of the DDT pumping system and/or the components of the DDT pumping system. In an embodiment, the controller 330 may interface with one or more Remote Terminal Units (RTU) 340. The RTU 340 may include communication and processing interfaces as well as collect sensor data from equipment attached to the RTU 340 and transmit them to the control system 330. In an embodiment, the control system 330 may act as supervisory control for several RTUs 340, each connected to an individual pump unit 302*a* thru 302*i*. The control system 330 and/or the RTU 340 may include one or more industrial control system (ICS), such as, for example, Supervisory Control and Data Acquisition (SCADA) systems, distributed control systems (DCS), and programmable logic controllers (PLCs), or other suitable control systems and/or control features without departing from the disclosure.

The controller 330 may be communicatively coupled to send signals and receive operational data from the hydraulic fracturing pump units 302*a* thru 302*j* via a communication interface 320, which may be any of one or more communication networks such as, for example, an Ethernet interface, a universal serial bus (USB) interface, or a wireless interface, or any other suitable interface. In certain embodiments, the controller 330 may be coupled to the pump units 302*a* thru 302*j* by way of a hard wire or cable, such as, for example, an interface cable. The controller 330 may include a computer system having one or more processors that may execute computer-executable instructions to receive and analyze data from various data sources, such as the pump units 302*a* thru 302*j*, and may include the RTU 340. The controller 330 may further provide inputs, gather transfer function outputs, and transmit instructions from any number of operators and/or personnel. The controller 330 may perform control actions as well as provide inputs to the RTU 340. In other embodiments, the controller 330 may determine control actions to be performed based on data received from one or more data sources, for example, from the pump units 302*a* thru 302*j*. In other instances, the controller 330 may be an independent entity communicatively coupled to the RTU 340.

Figure 6:
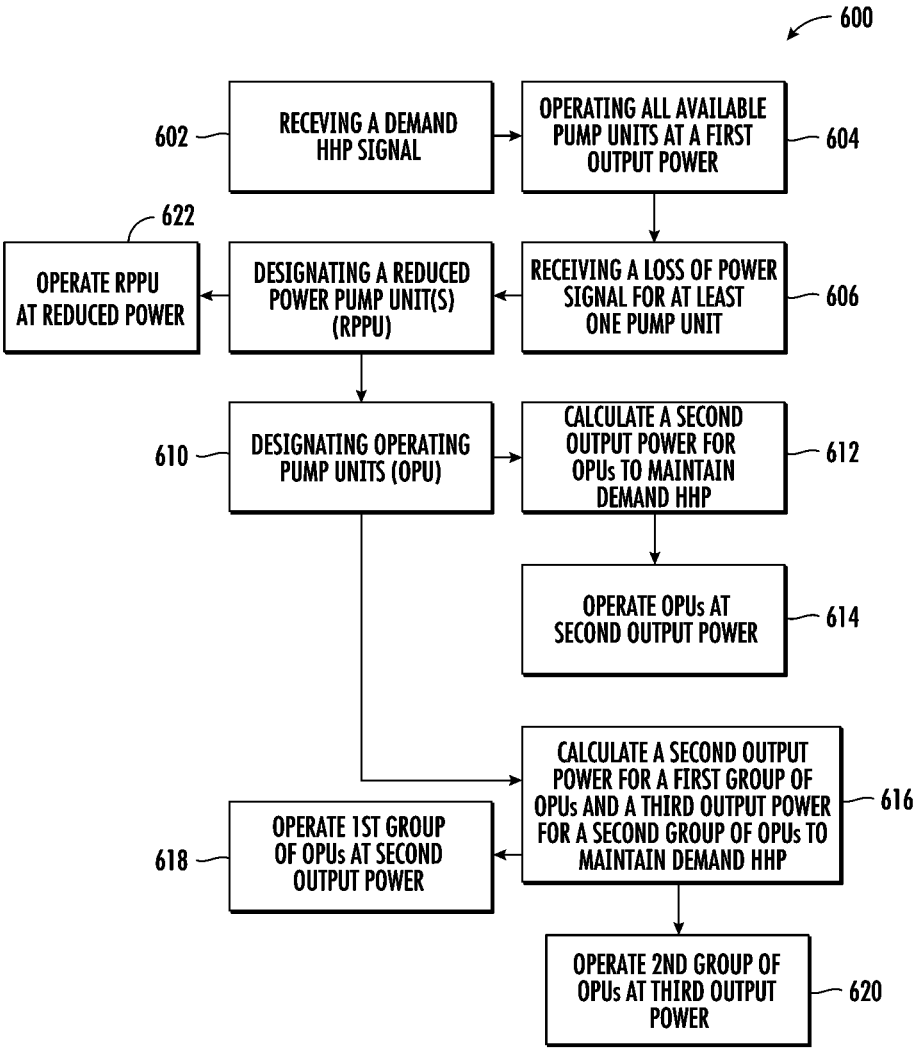
FIG. 6 is a flowchart of a method for operating a fleet of pumps in a DDT fluid pumping system according to an embodiment of the disclosure.

FIG. 6 shows one exemplary embodiment of a flow diagram of a method 600 of operating the plurality of pumps 302*a* thru 302*j* that may be executed by the controller 330. The controller 330 includes a memory that contains computer-executable instructions capable of receiving signals from the sensors associated with the pump units 302*a* thru 302*j*. As shown in FIG. 6, a demand Hydraulic Horse Power (HHP) signal from a master controller or from a controller associated with the fracturing process is received by the controller 330 (Step 602). By way of an example, the demand HHP signal may be a signal corresponding to the demanded power for pumping stimulation fluid associated with the fracturing process. When the demand HHP signal is received, the controller 330 directs operation of all available pump units 302*a* thru 302*j* at a first output power (Step 604). The first output power may be at a percentage rating at or below the MCP level of the pump units 302*a* thru 302*j*. In one example, the first output power may be in the range of approximately 70% to 100% of MCP. By way of an example, the controller 330 may command all the available pump units 302*a* thru 302*j* to operate at 100% of rated MCP based on the demand HHP Signal. In other instances, the controller 330 may command the available pump units 302*a* thru 302*j* to operate at a rated MCP of 70%, 80%, or 95%, based on the requested HHP demand. Alternatively, the controller 330 may command the available pump units 302*a* thru 302*j* to operate at a rated MCP below 70%, or any other rated MCP below 100% without departing from the disclosure.

During operation of the fluid pumping system 300, the controller 330 will monitor the operation of the pumping units 302*a* thru 302*j* including the power utilization and overall maintenance health of each pumping unit. The controller 330 may receive a signal for loss of power from one or more pumping units 302*a* thru 302*j* (Step 606). The loss of power signal may occur if one or more of the pump units 302*a* thru 302*j* loses power such that the detected output power of a respective pump is below the first output power. Further, the loss of power signal may occur if a respective pump unit 302*a* thru 302*j* is completely shut down and experiences a loss of power for any reason (e.g., loss of fuel to turbine 25). Further, one or more of the pump units 302*a* thru 302*j* may be voluntary taken out of service for routine service/maintenance issues including routine maintenance inspection or for other reasons. Upon receiving the loss of power signal, the controller 330 may designate one or more of the pump units 302*a* thru 302*j* as a Reduced Power Pump Unit (RPPU) (Step 608) and designate the remaining pump units as Operating Pump Units (OPUs) (Step 610). In one embodiment, the controller 330 will calculate a second output power at which the OPUs must operate to maintain the needed HHP of the fluid pumping system 400 based on the reduced operating power of the RPPU(s) (Step 612). In one embodiment, the second output power is greater than the first output power and may be in the range of approximately 70% of the MCP level to approximately the MIP level for the pumping units. The controller 330 will revise the operating parameters of the OPUs to operate at the calculated second output power to maintain the HHP of the fluid pumping system 400 (Step 614). The controller 330 continues to monitor the operation of the OPUs to maintain sufficient output of the fluid pumping units 302*a* thru 302*j* to meet the demand HHP for the system 400.

In an alternative embodiment of the method of operation, it may be desired to operate some of the OPUs at different operating powers. In this instance, after designating the OPUs at step 610, the controller 330 will calculate a second output power for a first group of OPUs and calculate a third output power for a second group of OPUs (step 616). In one embodiment, both the second output power and the third output power is greater than the first output power, but one or both of the second output power and the third output power may be equal to or below the first output power without departing from the disclosure. Both the second output power and the third output power may be in the range of approximately 70% of the MCP level to approximately the MIP level for the pumping units. The controller 330 operates the first group of OPUs at the second output power (step 618) and operates the second group of OPUs at the third output power (620) to maintain the sufficient output of the fluid pumping units 302*a* thru 302*j* to meet the demand HHP for the fluid pumping system 400.

The controller 330 will monitor the time that any of the pump units 302*a* thru 302*j* are operated at a second output power or third output power that exceeds the MCP level or approaches or exceeds the MIP level. Operators will be notified when operation of the system 400 at these elevated levels of output power exceed parameters that necessitate a shutdown of the system to avoid failure of the pumping units 302*a* thru 302*j*. Care should be taken to remedy the situation that caused the loss of power signal so that all the pumping units 302*a* thru 302*j* may be returned to their normal output power to maintain the desired HHP of the system 400.

In one embodiment, the loss of power signal received by the controller 330 at step 606 may indicate a reduction in the output power of one or more RPPUs and the controller will continue the operation of the detected RPPUs (step 622) at a reduced power level below the first output power. Further, the loss of power signal received by the controller 330 may indicate a complete loss of power of one or more of the RPPUs 302*a* thru 302*j*. If a complete loss of power of one or more of the pumping units 302*a* thru 302*j* is detected, the second output power and/or third output power would be higher to accommodate for the total loss of power of one or more of the pumping units. In one embodiment, the controller 330 calculates the second output power and/or third output power for the OPUs 302*a*-302*j* in the form of a flow adjustment needed for the OPUs. The second output power and/or third output power of the OPUs 302*a*-302*j* may require operation of the OPUs at or above MIP level for a short period of time (e.g., 30 minutes) while the issues that triggered the loss of power signal (step 606) is corrected.

In one embodiment, during the loss of one or more pump units 302*a*-302*j*, the controller 330 may be able to meet the demand HHP by operating all of the OPUs at a second output power of 100% MCP level. In other embodiments, the controller 330 would be able to meet the demand HHP only by operating all of the OPUs 302*a*-302*j* at a second output power at the MIP level (e.g., 107% of MCP level). In other embodiments, the controller 330 would be able to meet the demand HHP by operating the first group of OPUs 302*a*-302*j* at a second output power at the MIP level and operating the second group of OPUs at a third output power at the MCP level.

By way of an example, for the ten pump unit system 400 shown in FIG. 2, the controller 330 may be able to maintain the demand HHP when one of the ten pump units 302*a*-302*j* is offline (designated the RPPU) by operating two of the OPUs at the MIP level and seven of the OPUs at the MCP level. In another example, the controller 330 may be able to operate three of the OPUs 302*a*-302*j* at the MIP level and six of the OPUs at the MCP level. In another example, the controller may be able to operate one of the OPUs 302*a*-302*j* at the MIP level and eight of the OPUs at the MCP level. In another example, the controller may be able to operate four of the OPUs 302*a*-302*j* at the MIP level and five of the OPUs at the MCP level. The controller 330 may operate various other quantities of OPUs 302*a*-302*j* operating at a second output power and/or third output power without departing from the disclosure.

Figure 7:
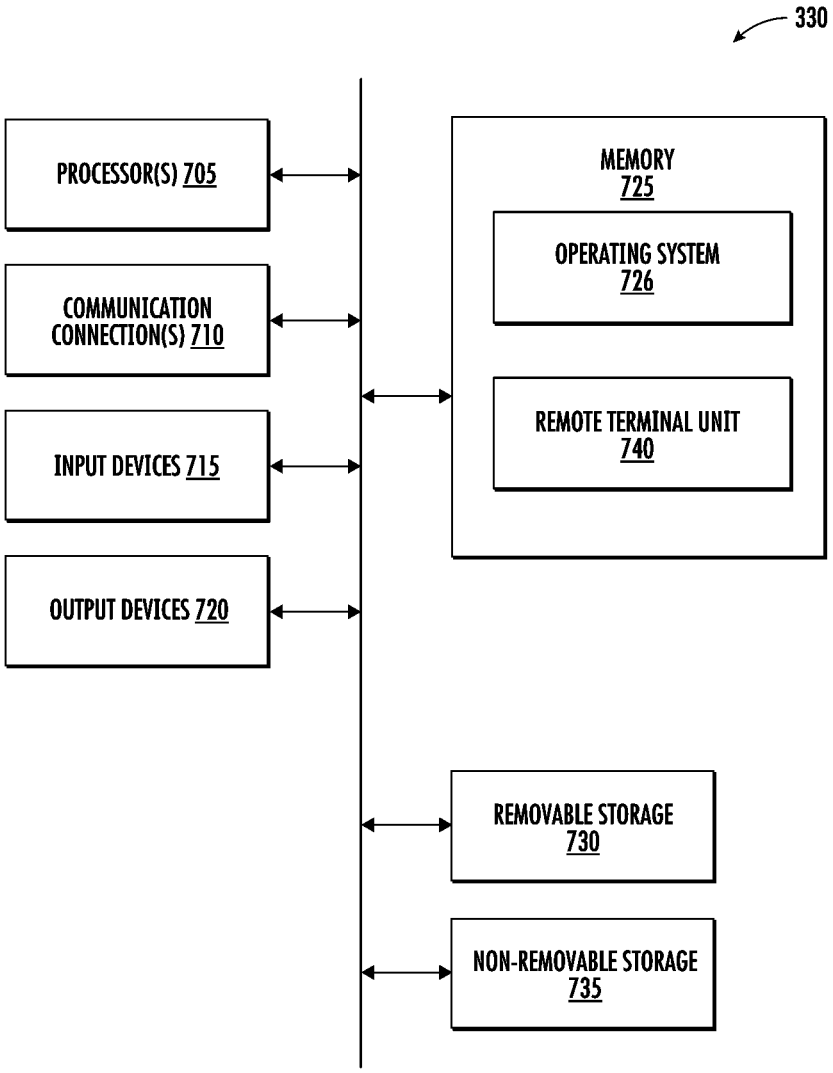
FIG. 7 is a schematic diagram of a controller configured to control operation of the DDT fluid pumping system according to an embodiment of the disclosure.

FIG. 7 illustrates the controller 330 configured for implementing certain systems and methods for operating a fleet of pumps in accordance with certain embodiments of the disclosure. The controller 330 may include a processor 705 to execute certain operational aspects associated with implementing certain systems and methods for operating a fleet of pumps in accordance with certain embodiments of the disclosure. The processor 705 may communicate with a memory 725. The processor 705 may be implemented and operated using appropriate hardware, software, firmware, or combinations thereof. Software or firmware implementations may include computer-executable or machine-executable instructions written in any suitable programming language to perform the various functions described. In one embodiment, instructions associated with a function block language may be stored in the memory 725 and executed by the processor 705.

The memory 725 may be used to store program instructions, such as instructions for the execution of the method 600 described above or other suitable variations. The instructions are loadable and executable by the processor 705 as well as to store data generated during the execution of these programs. Depending on the configuration and type of the controller 330, the memory 725 may be volatile (such as random access memory (RAM)) and/or non-volatile (such as read-only memory (ROM), flash memory, etc.). In some embodiments, the memory devices may include additional removable storage 730 and/or non-removable storage 735 including, but not limited to, magnetic storage, optical disks, and/or tape storage. The disk drives and their associated computer-readable media may provide non-volatile storage of computer-readable instructions, data structures, program modules, and other data for the devices. In some implementations, the memory 725 includes multiple different types of memory, such as static random access memory (SRAM), dynamic random access memory (DRAM), or ROM.

The memory 725, the removable storage 730, and the non-removable storage 735 are all examples of computer-readable storage media. For example, computer-readable storage media may include volatile and non-volatile, removable and non-removable media implemented in any method or technology for storage of information such as computer-readable instructions, data structures, program modules or other data. Additional types of computer storage media that may be present include, but are not limited to, programmable random access memory (PRAM), SRAM, DRAM, RAM, ROM, electrically erasable programmable read-only memory (EEPROM), flash memory or other memory technology, compact disc read-only memory (CD-ROM), digital versatile discs (DVD) or other optical storage, magnetic cassettes, magnetic tapes, magnetic disk storage or other magnetic storage devices, or any other medium which may be used to store the desired information and which may be accessed by the devices. Combinations of any of the above should also be included within the scope of computer-readable media.

Controller 330 may also include one or more communication connections 710 that may allow a control device (not shown) to communicate with devices or equipment capable of communicating with the controller 330. The controller 330 may also include a computer system (not shown). Connections may also be established via various data communication channels or ports, such as USB or COM ports to receive cables connecting the controller 330 to various other devices on a network. In one embodiment, the controller 330 may include Ethernet drivers that enable the controller 130 to communicate with other devices on the network. According to various embodiments, communication connections 710 may be established via a wired and/or wireless connection on the network.

The controller 330 may also include one or more input devices 715, such as a keyboard, mouse, pen, voice input device, gesture input device, and/or touch input device, or any other suitable input device. It may further include one or more output devices 720, such as a display, printer, and/or speakers, or any other suitable output device. In other embodiments, however, computer-readable communication media may include computer-readable instructions, program modules, or other data transmitted within a data signal, such as a carrier wave, or other transmission.

In one embodiment, the memory 725 may include, but is not limited to, an operating system (OS) 726 and one or more application programs or services for implementing the features and aspects disclosed herein. Such applications or services may include a Remote Terminal Unit 340, 740 for executing certain systems and methods for operating a fleet of pumps in a hydraulic fracturing application. The Remote Terminal Unit 340, 740 may reside in the memory 725 or may be independent of the controller 330, as represented in FIG. 3. In one embodiment, Remote Terminal Unit 340, 740 may be implemented by software that may be provided in configurable control block language and may be stored in non-volatile memory. When executed by the processor 705, the Remote Terminal Unit 340, 740 may implement the various functionalities and features associated with the controller 330 described in this disclosure.

As desired, embodiments of the disclosure may include a controller 330 with more or fewer components than are illustrated in FIG. 7. Additionally, certain components of the controller 330 of FIG. 7 may be combined in various embodiments of the disclosure. The controller 330 of FIG. 7 is provided by way of example only.

In some embodiments, the sizing of downstream equipment (e.g., pump unit discharge piping, manifold, etc.) should be increased compared to that sizing of the standard power output downstream equipment of the pump units to take advantage at operating at the elevated output power of the pump unit during short term use. The pump unit power rating should be increased to allow for the maximum intermittent power of the engine. Further, the size and torque rating of the driveshaft and if applicable torsional vibration dampeners and flywheels also be considered when designing the power train.

Examples of such configurations in a dual shaft, dual fuel turbine engine with a rated shaft horse power of 5100 at standard ISO conditions is used in conjunction with a reduction Helical Gearbox that has a constant running power rating of 5500 SHP & an intermittent power output of 5850 SHP. The engine, gearbox assembly, and the drive shaft should be sized and selected to be able to meet the power and torque requirements at not only the constant running rating of the pump units but also the intermittent/increased loads. In one example, a 390.80 GWB driveshaft may be selected. The drive train may include torsional vibration dampeners as well as single mass fly wheels and their installation in the drive train is dependent on the results from careful torsional vibration analysis. The pump unit may be rated to an elevated horsepower above that of the engine. Common pumps on the market are rated at 7000 HP with the next lowest pump being rated to 5000 HP respectively. The sizing, selection, and assembly of such a drive train would allow reliable operation of the turbine engine above the 100% rated HP value with the resulting hydraulic horse power (HHP) produced being dependent on environmental and other conditions.

References are made to block diagrams of systems, methods, apparatuses, and computer program products according to example embodiments. It will be understood that at least some of the blocks of the block diagrams, and combinations of blocks in the block diagrams, may be implemented at least partially by computer program instructions. These computer program instructions may be loaded onto a general purpose computer, special purpose computer, special purpose hardware-based computer, or other programmable data processing apparatus to produce a machine, such that the instructions which execute on the computer or other programmable data processing apparatus create means for implementing the functionality of at least some of the blocks of the block diagrams, or combinations of blocks in the block diagrams discussed.

These computer program instructions may also be stored in a non-transitory computer-readable memory that may direct a computer or other programmable data processing apparatus to function in a particular manner, such that the instructions stored in the computer-readable memory produce an article of manufacture including instruction means that implement the function specified in the block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide task, acts, actions, or operations for implementing the functions specified in the block or blocks.

One or more components of the systems and one or more elements of the methods described herein may be implemented through an application program running on an operating system of a computer. They also may be practiced with other computer system configurations, including handheld devices, multiprocessor systems, microprocessor based or programmable consumer electronics, mini-computers, mainframe computers, and the like.

Application programs that are components of the systems and methods described herein may include routines, programs, components, data structures, and so forth that implement certain abstract data types and perform certain tasks or actions. In a distributed computing environment, the application program (in whole or in part) may be located in local memory or in other storage. In addition, or alternatively, the application program (in whole or in part) may be located in remote memory or in storage to allow for circumstances where tasks may be performed by remote processing devices linked through a communications network.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. A method of operating a plurality of pump units associated with a high-pressure, high-power hydraulic fracturing assembly, each of the pump units including a turbine engine, a driveshaft, a gearbox connected to the turbine engine and driveshaft for driving the driveshaft, and a pump connected to the driveshaft, the method comprising:

receiving a demand hydraulic horse power (HHP) signal for operation of the hydraulic fracturing assembly;

based at least in part on the demand HHP signal, operating all available pump units of the plurality of pump units at a first output power to achieve the demand HHP;

receiving a loss of power signal for at least one pump unit of the plurality of pump units during operation of the plurality of pump units;

after receiving the loss of power signal, designating the at least one pump unit as a reduced power pump unit (RPPU) and the remaining pump units as operating pump units (OPU); and operating at least one of the OPUs at a second output power to meet the demand HHP signal for operation of the hydraulic fracturing assembly, the first output power being in the range of approximately 70% to 100% of a maximum continuous power (MCP) level of the plurality of pump units, the second output power being greater than the first output power and being in the range of approximately 70% of the MCP level to approximately a maximum intermittent power (MIP) level of the plurality of pump units.

2. The method of claim 1, further comprising operating at least one of the OPUs at a third output power, the third output power being in the range of approximately 70% to approximately the MIP level.

3. The method of claim 2, wherein the third output power is greater than the first output power.

4. The method of claim 2, wherein the third output power is approximately equal to the first output power.

5. The method of claim 1, wherein the at least one RPPU comprises one pump unit, and wherein the OPUs operating at the second output power comprise one or more less pump units than the plurality of pump units.

6. The method of claim 1, wherein the at least one pump unit of the OPUs comprises all of the OPUs, and wherein the second output power comprises the MIP level.

7. The method of claim 1, wherein the first output power is 100% of the MCP level.

8. The method of claim 1, wherein the first output power is 90% of the MCP level.

9. The method of claim 8, wherein the second output power is 107% of the MCP level.

10. The method of claim 9, wherein the second output power is the MIP level.

11. The method of claim 1, wherein the at least one pump unit of the OPUs comprises at least two pump units, and wherein the second output power comprises the MIP level.

12. The method of claim 1, further comprising operating the at least one RPPU at a reduced output power below the first output power.

13. The method of claim 12, wherein the reduced output power of the RRPU is approximately 20% less than the first output power.

14. The method of claim 1, further comprising shutting down the at least one RPPU, and wherein the second output power is approximately the MIP level.

15. A system to control operation of a plurality of pump units associated with a hydraulic fracturing assembly, each of the pump units including a turbine engine, connected to a gearbox for driving a driveshaft, and a pump connected to the drive shaft, the system comprising:

a controller in communication with the plurality of pump units, the controller including one or more processors and memory having computer-readable instructions stored therein and operable by the processor to:

receive a demand hydraulic horse power (HHP) signal for the hydraulic fracturing assembly, based at least in part on the demand HHP signal, operate all available pump units of the plurality of pump units at a first output power to achieve the demand HHP;

receive a loss of power signal from at least one pump unit of the plurality of pump units, after receiving the loss of power signal, designate the at least one pump unit as a reduced power pump unit (RPPU), and designate the remaining pump units as operating pump units (OPU), and operate one or more of the OPUs at a second output power to meet the demand HHP signal of the hydraulic fracturing system, the first output power being in the range of approximately 70% to 100% of a maximum continuous power (MCP) level of the plurality of pump units, the second output power being greater than the first output power and being in the range of approximately 70% of MCP level to approximately a maximum intermittent power (MIP) level of the plurality of pump units.

16. The system of claim 15, wherein after receiving the loss of power signal, the computer readable instructions are operable to operate at least one of the OPUs at a third output power, the third output power being in the range of approximately 70% to approximately the MIP level.

17. The system of claim 16, wherein the third output power is greater than the first output power.

18. The system of claim 16, wherein the third output power is approximately equal to the first output power.

19. The system of claim 16, wherein the at least one RPPU comprises one pump unit, and wherein the OPUs comprise one less pump unit than the plurality of pump units.

20. The system of claim 16, wherein the at least one pump unit of the OPUs comprises all of the OPUs, and wherein the second output power comprises the MIP level.

21. The system of claim 16, wherein the first output power is 100% of the MCP.

22. The system of claim 21, wherein the second output power 107% of the MCP level.

23. The system of claim 22, wherein the second output power is the MIP level.

24. The system of claim 16, wherein the first output power is 90% of the MCP level.

25. The system of claim 16, wherein the at least one pump unit of the OPUs comprises at least two pump units, and wherein the second output power comprises the MIP level.

26. The system of claim 16, wherein after receiving the loss of power signal, the computer readable instructions are operable to operate the at least one RPPU at a reduced output power below the first output power.

27. The system of claim 26, wherein the reduced output power of the RRPU is approximately 20% less than the first output power.

28. The system of claim 16, wherein after receiving the loss of power signal, the computer readable instructions are operable to shut down the at least one RRPU, and the second output power is approximately the MIP level.

* * * * *